US007667127B2

(12) United States Patent
Ikeya

(10) Patent No.: US 7,667,127 B2
(45) Date of Patent: Feb. 23, 2010

(54) ELECTRONIC MUSICAL APPARATUS HAVING AUTOMATIC PERFORMANCE FEATURE AND COMPUTER-READABLE MEDIUM STORING A COMPUTER PROGRAM THEREFOR

(75) Inventor: Tadahiko Ikeya, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 12/025,368

(22) Filed: Feb. 4, 2008

(65) Prior Publication Data

US 2008/0127811 A1 Jun. 5, 2008

Related U.S. Application Data

(62) Division of application No. 10/741,327, filed on Dec. 19, 2003, now Pat. No. 7,355,111.

(30) Foreign Application Priority Data

Dec. 26, 2002 (JP) ..... 2002-378419

(51) Int. Cl.
*G10H 1/00* (2006.01)

(52) U.S. Cl. ..... 84/622; 84/600; 84/625; 84/659

(58) Field of Classification Search ..... 84/600–602, 84/622, 625, 659
See application file for complete search history.

(56) References Cited

U.S. PATENT DOCUMENTS 4,327,622 A * 5/1982 Aoki ..... 84/715
5,042,355 A * 8/1991 Kozuki ..... 84/618
5,085,118 A * 2/1992 Sekizuka ..... 84/635
5,532,425 A * 7/1996 Nakata et al. ..... 84/609

(Continued)

FOREIGN PATENT DOCUMENTS

JP 8-179763 A 7/1996

(Continued)

OTHER PUBLICATIONS

Partial English translation of Office Action, dated Oct. 10, 2006, issued in Japanese patent application No. 2002-378419 which corresponds to the parent application.

*Primary Examiner*—David S. Warren
(74) *Attorney, Agent, or Firm*—Rossi, Kimms & McDowell, LLP

(57) ABSTRACT

In an automatic performance system, song and style data DAi and DCj (i:1 through n, j:1 through m) contains tempo and meter data TPa, TMa; TPc, TMc, respectively, so that the style data DCj whose tempo and meter data matches with those of the song data DAi is reproduced concurrently with the song data DAi. On the basis of user's settings, furthermore, style setting data SS (DBi) indicating style data DCk (k:1 through m) to be concurrently reproduced and tone color setting data VS (DBi) for setting a manual tone color are stored in association with the song data DAi. Based on the style setting data SS, the style data DCk associated with the song data DAi is reproduced concurrently with the song data DAi, or a manual performance is conducted, during the reproduction of the song data DAi, on the basis of tone color data derived from the tone color setting data VS. As described above, settings of a style and tone color for manual performance suitable for a song is achieved.

4 Claims, 5 Drawing Sheets

U.S. PATENT DOCUMENTS 5,696,343 A * 12/1997 Nakata ..... 84/609
5,824,932 A 10/1998 Nakata
5,831,195 A * 11/1998 Nakata ..... 84/609
5,859,381 A * 1/1999 Takahashi et al. ..... 84/613
5,859,382 A * 1/1999 Funaki ..... 84/637
5,918,303 A * 6/1999 Yamaura et al. ..... 84/609
5,998,724 A 12/1999 Takeuchi et al.
6,175,071 B1 1/2001 Ito
6,245,984 B1 6/2001 Aoki et al.
6,518,491 B2 * 2/2003 Kurakake et al. ..... 84/610

FOREIGN PATENT DOCUMENTS

JP 8-211865 A 8/1996
JP 10-207460 A 8/1998
JP 11-153992 A 6/1999

* cited by examiner

ELECTRONIC MUSICAL APPARATUS HAVING AUTOMATIC PERFORMANCE FEATURE AND COMPUTER-READABLE MEDIUM STORING A COMPUTER PROGRAM THEREFOR

This is a divisional of U.S. patent application Ser. No. 10/741,327 filed Dec. 19, 2003, now U.S. Pat. No. 7,355,111.

BACKGROUND OF THE INVENTION

1. Field of the Invention

The present invention relates to an automatic performance system in which, on automatic performance of song data comprising melody data, chord progression data, etc., a style (accompaniment pattern) and a tone color for manual performance are specified suitably for the song data.

2. Description of the Related Art

Conventionally, there has been a well-known art such as Japanese Laid-Open No. H8-179763 which adds or arranges an accompaniment part which song data lacks by reproducing the song data which is major performance data including melody data and chord progression data concurrently with style data which is accompaniment pattern data.

In the above related art, the style data to be reproduced concurrently with the song data is previously contained in the song data. Alternatively, the previously provided style data is left user-customizable. Generally, however, style data is not contained in the format of song data in most cases. As a result, when song data without style data is reproduced, it is impossible to reproduce style data concurrently with the song data.

Moreover, when a user conducts a manual performance by operating performance operators such as a keyboard while reproducing song data, a tone color for manual performance is previously specified for each song data in some rare cases. In most formats, however, song data has no specification of tone color for manual performance.

SUMMARY OF THE INVENTION

The present invention was accomplished to solve the above-described problems, and an object thereof is to provide an automatic performance apparatus capable of, on the occasion of automatic performance of song data, concurrently reproducing song data and style data matching with the song. The object of the present invention also lies in providing an automatic performance apparatus capable of setting a style even for song data having a format in which style data is unable to be set. Further, the object of the present invention lies in providing an automatic performance apparatus capable of setting a tone color even for song data having a format in which tone color data for manual performance during the reproduction of song data is unable to be set.

A feature of the present invention is to provide a song storage portion for storing sets of song data for automatic performance, the song data including at least one of tempo data and meter data, a style storage portion for storing sets of style data including at least one of tempo data and meter data along with accompaniment data, a search portion for searching the style storage portion for style data having at least one of tempo data and meter data matching with at least one of tempo data and meter data in song data selected from said song storage portion, and a reproduction portion for concurrently reproducing the selected song data and the searched style data. In this case, for example, the song data includes melody data and chord progression data.

According to the feature, the song data includes at least one of the tempo and meter data, while the style data includes at least one of the tempo and meter data. On automatic performance, the style data having at least one of the tempo and meter data matching with at least one of the tempo and meter data in the selected song data is retrieved in order to reproduce the retrieved style data in synchronization with the song data. As a result, an automatic setting of suitable style data is accomplished even if style data is not preset in the song data.

Another feature of the present invention is to provide a song storage portion for storing sets of song data for automatic performance, a style storage portion for storing sets of style data including accompaniment pattern data, a style setting portion for preparing, on the basis of user's operation, style setting data indicating style data to be reproduced concurrently with song data in the song storage portion, a style setting storage portion for storing the prepared style setting data in association with the song data, and a reproduction portion for reproducing the song data selected from the song storage portion and concurrently reproducing the style data read out from the style storage portion on the basis of the style setting data associated with the song data.

In this case, for example, the song data also includes melody data and chord progression data. The style setting portion prepares style setting data indicating style data selected from among the sets of style data stored in said style storage portion.

According to the feature, the style data to be reproduced concurrently with the song data is set by a user, and the style setting data indicative of the set style data is stored (in a file different from the one storing song data) in association with the song data. On the reproduction of the song data, the stored style setting data is read out in order to concurrently reproduce the style data set for the song data. As a result, a setting of suitable style data is accomplished without the need for modifying song data even if the song data has a format (e.g., commonly used SMF) which does not allow the presetting of the style data.

An additional feature of the present invention is to provide a song storage portion for storing sets of song data for automatic performance, a performance tone color setting portion for preparing, on the basis of user's operation, tone color setting data indicating a tone color for performance data generated in accordance with user's performance operation operated concurrently with reproduction of song data in the song storage portion, a performance tone color storage portion for storing said prepared tone color setting data in association with the song data, and a reproduction portion for concurrently reproducing the song data selected from the song storage portion and performance data performed by the user, while imparting, to the performance data performed by the user, the tone color based on the tone color setting data read out from the performance tone color storage portion in association with the song data. In this case, for example, the song data also includes melody data and chord progression data.

According to the feature of the present invention, a tone color (manual performance tone color) for manual performance during the reproduction of the song data is set by the user, and the tone color setting data for imparting the set manual performance tone color is stored (in a file different from the one storing song data) in association with the song data. On the reproduction of the song data, the stored tone color setting data is read out in order to conduct a manual performance with the associated tone color data. As a result, a setting of tone color for manual performance is accomplished without the need for modifying song data even if the song data has a format (e.g., commonly used SMF) which does not allow the presetting of manual performance tone color.

The present invention may be configured and embodied not only as an invention of an apparatus but also as an invention of a method. In addition, the present invention may be embodied in a form of a program for a computer or processor such as a DSP. The present invention may also be embodied in a form of a storage medium storing the program.

DESCRIPTION OF THE PREFERRED EMBODIMENT

[System Overview]

Figure 1:
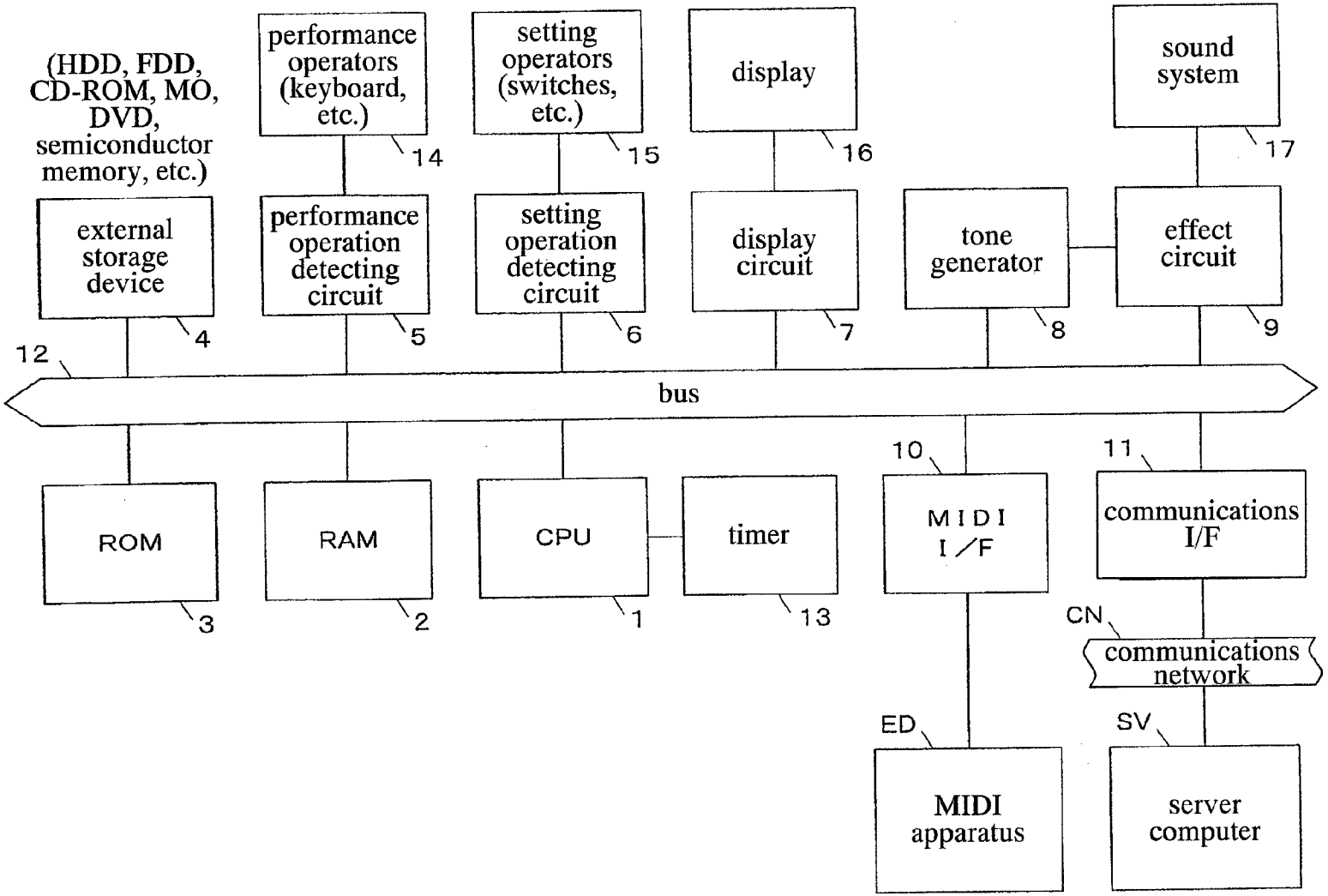
FIG. 1 is a block diagram showing a hardware configuration of an electronic musical instrument in which an automatic performance apparatus according to an embodiment of the present invention is equipped.

In an embodiment of the present invention, an electronic musical instrument is used as a musical tone information processing apparatus which implements an automatic performance function. FIG. 1 is a block diagram showing a hardware configuration of the system of the electronic musical instrument having the automatic performance function according to the embodiment of the present invention. The electronic musical instrument has a central processing unit (CPU) 1, random access memory (RAM) 2, read-only memory (ROM) 3, external storage device 4, performance operation detecting circuit 5, setting operation detecting circuit 6, display circuit 7, tone generator 8, effect circuit 9, MIDI interface (I/F) 10, communications interface (I/F) 11, etc. These devices 1 through 11 are interconnected via a bus 12.

The CPU 1 executes given control programs in order to perform various musical tone information processes, using a clock by a timer 13. The musical tone information processes include various processes for automatic performance such as a song selection process, song reproduction process, manual performance process, and style and manual performance tone color changing process. The RAM 2 is used as a working area for temporarily storing various data necessary for the above processes. In the ROM 3 there are previously stored various control programs, data, and parameters necessary for implementing the processes. The external storage device 4 includes storage media such as a hard disk (HD), compact disk read only memory (CD-ROM), flexible disk (FD), magneto-optical disk (MO), digital versatile disk (DVD) and semiconductor memory. For example, the ROM 3 or external storage device 4 can store a song data file (DA), style data file (DC), tone color data file, etc., while the external storage device 4 can store a style and tone color setting data file (DB).

The performance operation detecting circuit 5 detects performance operations done by performance operators 14 such as a keyboard or wheel, while the setting operation detecting circuit 6 detects setting operations done by setting operators 15 such as numeric/cursor keys and panel switches. The performance operation detecting circuit 5 and setting operation detecting circuit 6 then transmit information corresponding to the detected operations to the system. The display circuit 7 has a display unit for displaying various frames and various indicators (lamps), controlling the display unit and indicators under the direction of the CPU 1 in order to support the display corresponding to the operations done by the operators 14 and 15.

The tone generator 8 generates musical tone signals corresponding to data such as performance data from the performance operators 14 and song data automatically performed. To the musical tone signals there is added a given effect including a tone color by the effect circuit 9 having a DSP for adding effects. Connected to the effect circuit 9 is a sound system 17, which has a D/A converter, amplifiers and speakers and generates musical tones based on the effect-added musical tone signals.

To the MIDI I/F 10 there is connected a different electronic musical instrument (MIDI apparatus) ED in order to allow the transmission of musical information such as song data (DA) between the electronic musical instrument and the different electronic musical instrument (MIDI apparatus) ED. To the communications I/F 11 there is connected a communications network CN such as the Internet or a local-area network (LAN) in order to download various information (e.g., in addition to control programs, musical information such as song data (DA) also included) from an external server computer SV and store the downloaded information in the external storage device 4.

[Data Format]

Figure 2:
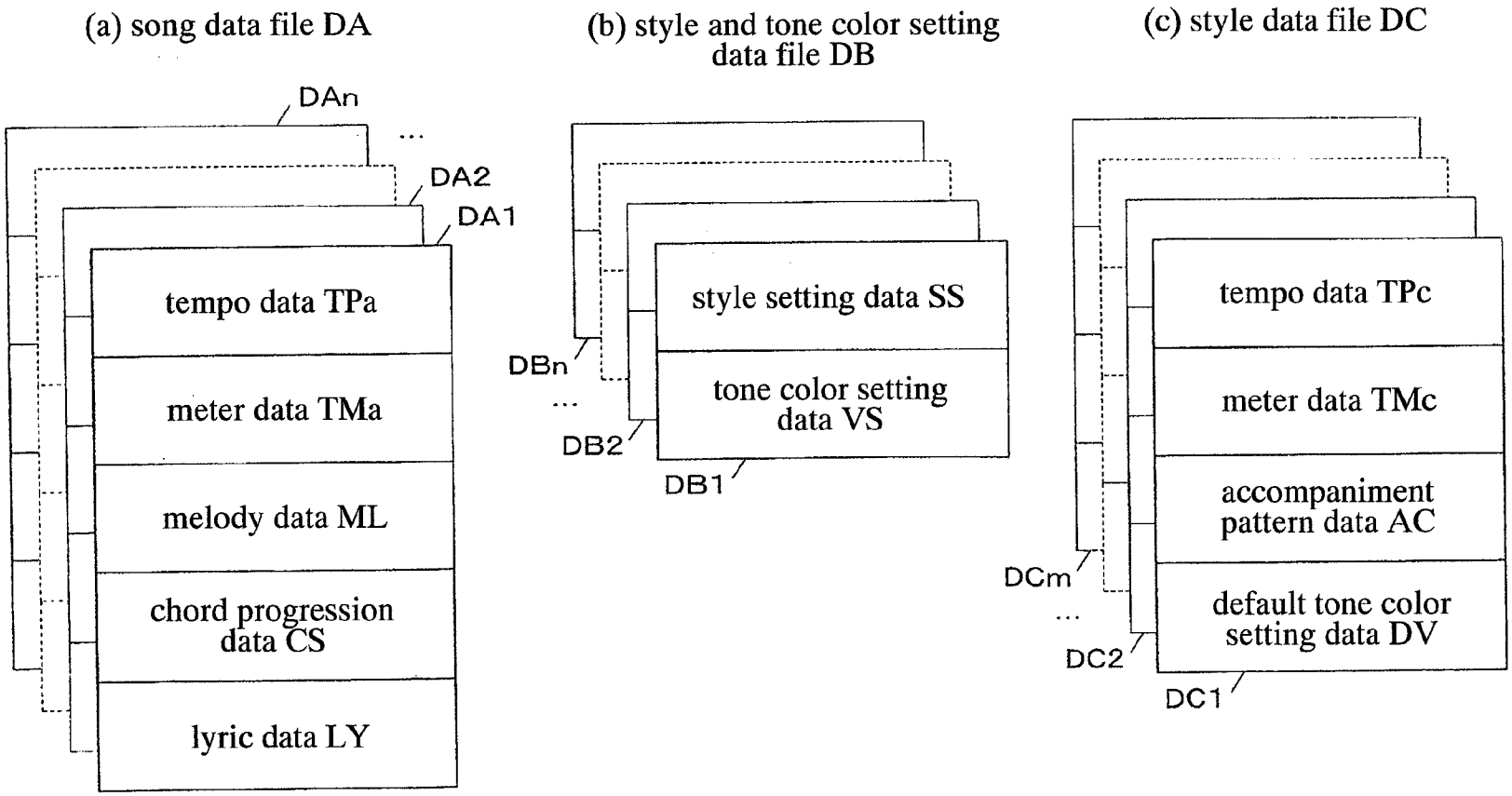
FIG. 2 is a diagram describing formats of data used in the automatic performance apparatus (electronic musical instrument) according to the embodiment of the present invention.

FIG. 2 is a diagram describing formats of data used in the automatic performance apparatus (electronic musical instrument) according to the embodiment of the present invention. In the song data file DA, as shown in FIG. 2 (*a*), there is contained song data DA1 through DAn for a plurality of music pieces (n pieces). Each set of song data DA1 through DAn comprises tempo data TPa, meter data TMa, melody data ML, chord progression data CS, lyric data LY, etc., which is previously stored in the ROM 3 or external storage device 4. As described above, each set of song data DA1 through DAn contains the tempo data Tpa and meter data TMa.

In the style and tone color setting data file DB, as shown in FIG. 2 (*b*), there are contained sets (n sets if provided for all sets of the song data) of style and tone color setting data DB1 through DBn, which are associated with the song data DA1 through DAn, respectively. Each set of the style and tone color setting data DB1 through DBn comprises a pair of style setting data (accompaniment pattern setting data) SS and tone color setting data VS. The style and tone color setting data DB1 through DBn is adapted to be provided on the basis of user's setting operations in association with the song data DA1 through DAn. More specifically, when a style and tone color are provided for each of the song data DA1 through DAn by user's operations, the style and tone color setting data DB1 through DBn is stored in association with the song data in the external storage device 4 with the same filename (having a different extension) as the associated song data DA1 through DAn given. In each set of the style and tone color setting data DB1 through DBn, there is recorded the style setting data SS and tone color setting data VS in accordance with user's settings of a style and tone color. If no style and tone color is provided for a set of the song data, no data SS and VS is provided for the associated style and tone color setting data.

As shown in FIG. 2 (*c*), the style data file DC is formed by sets (m sets) of style data DC1 through DCm, each of which comprises tempo data TPc, meter data TMc, accompaniment pattern data AC, default tone color setting data DV, etc. The style data file DC is previously stored in the ROM 3 or external storage device 4. As described above, also in each set of the style data DC1 through DCm, there is contained the tempo data TPc and meter data TMc. As a result, at the automatic performance of a given set of the song data DAi (i: 1 through n), the style data file DC is searched for style data DCj having the tempo data TPc and meter data TMc which matches the tempo data TPa and meter data TMa of the song data, so that accompaniment tones based on the located style data DCj are reproduced concurrently with the song data DAi.

In this embodiment, the style setting data (accompaniment pattern setting data) SS contained in each set of the style and tone color setting data DB1 through DBn in the style and tone color setting data file DB is the data provided on the basis of user's setting operation for designating, from among the style data DC1 through DCm in the style data file DC, style data DCk (k: 1 through m) to be concurrently reproduced in association with a given set of the song data DA1 through DAn. As a result, at the automatic performance of the given song data DAi, the style setting data SS contained in the associated style and tone color setting data DBi allows the designation of the style data DCk desired by the user's operation.

The tone color setting data VS contained in each set of the style and tone color setting data DB1 through DBn is the data provided on the basis of user's operation for designating, from among sets of tone color data in a tone color data file separately provided in the ROM 3 or external storage device 4, tone color data to be used at the manual performance performed concurrently with the associated song data DA1 through DAn. As a result, at the manual performance during the reproduction of the given song data DAi, the tone color setting data VS in the associated style and tone color setting data DBi allows the designation of the tone color desired by the user's operation for implementing the manual performance with the associated tone color.

Next, the feature of automatic performance according to the embodiment of the present invention will be briefly described through the examples of the data formats shown in FIG. 2. In this automatic performance system, in order to designate a style and manual tone color suitable for a song, both sets of the song and style data DAi; DCj (i: 1 through n, j: 1 through m) contain the tempo or meter data TPa, TMa; TPc, TMc, respectively, so that the style data DCj whose tempo or meter data matches the song data DAi is reproduced concurrently with the song data DAi. On the basis of user's setting operation, furthermore, the automatic performance system stores the style setting data SS (DBi) in association with the song data DAi, the style setting data SS arbitrarily designating the style data DCk (k: 1 through m) to be concurrently reproduced. The style setting data SS allows the synchronous reproduction of the song data DAi and the style data DCk associated with the song data DAi. In addition, on the basis of user's setting operation, the automatic performance system also stores, in association with the song data DAi, the tone color setting data VS (DBi) for arbitrarily designating a manual tone color. On the basis of the tone color data derived from the tone color setting data VS (DBi), a manual performance is performed concurrently with the reproduction of the song data DAi.

EXAMPLES of OPERATIONAL FLOWS

In the embodiment of the present invention, the startup of the electronic musical instrument causes a main process which is not shown to start. The main process detects operations of the setting operators 15 for instructing the execution of corresponding musical tone information processing routines. The musical tone information processing routines include a song selection process [1], song reproduction process [2], manual performance process [3] and style and manual performance tone color changing process [4]. FIGS. 3 through 6 show flowcharts illustrating examples of operations done in the automatic performance apparatus (electronic musical instrument) according to the embodiment of the present invention. Hereinafter, operational flows of the above processes [1] through [4] will be described, using FIGS. 3 through 6.

Figure 3:
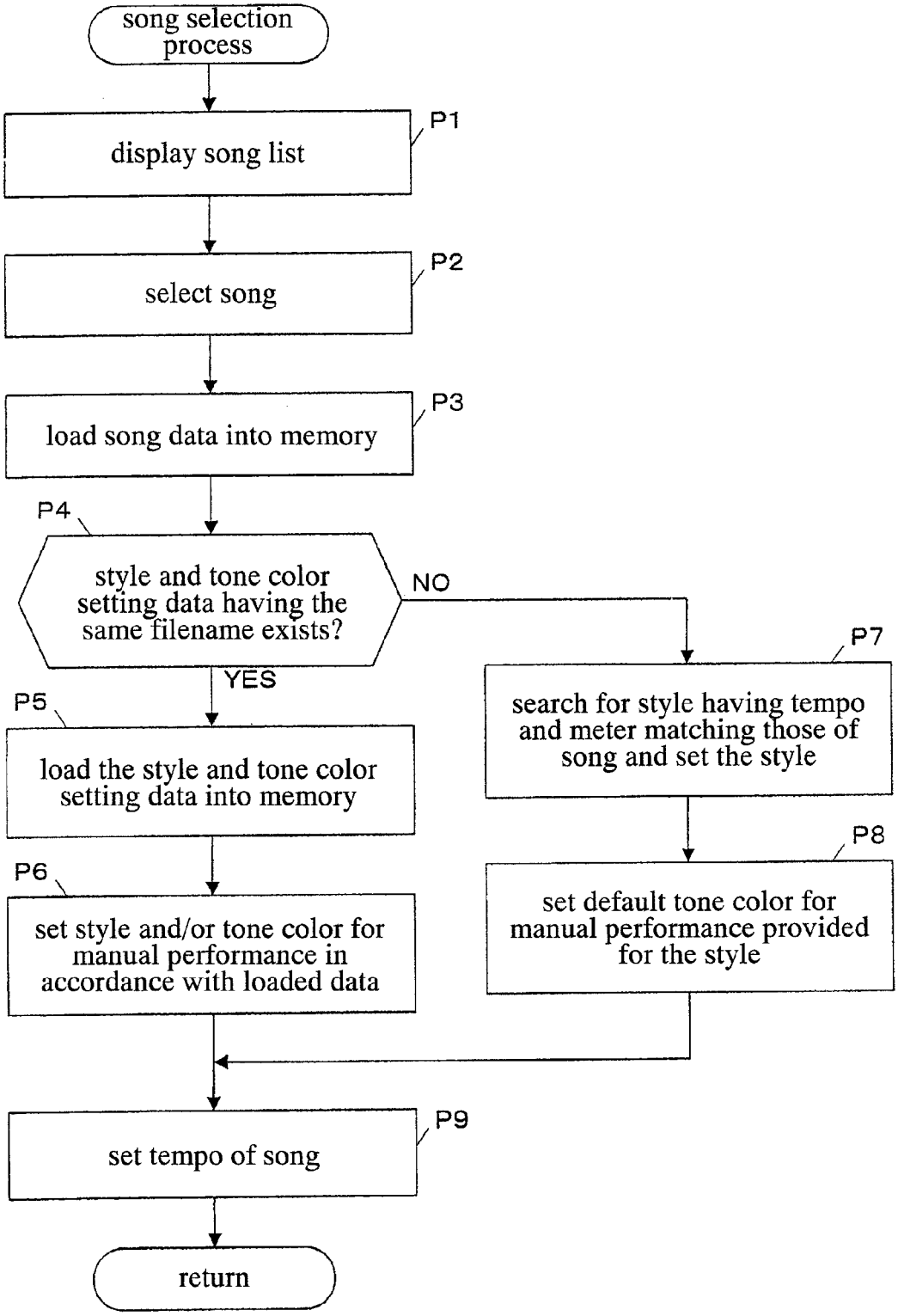
FIG. 3 is a flowchart showing an example of operations done in a song selection process according to the embodiment of the present invention.

[1] Song Selection Process (FIG. 3)

When a predetermined operator of the setting operators 15 is operated in order to give an instruction to start the song selection process, the CPU 1 first displays a song list on a song-selection screen shown on a display unit 16 (step P1), presenting sets (n sets) of song data DA1 through DAn stored in the song data file DA [FIG. 2 (*a*)] in the ROM 3 or external storage device 4 on the basis of song names and required items in the song list. When a song desired to be automatically performed is selected from the song list by a user's operation (step P2), the CPU 1 loads, from among the song data DA1 through DAn, a set of song data DAi (i: 1 through n) which corresponds to the selected song into memory, that is, into the RAM 2 (step P3). The CPU 1 then determines whether there exists a set of style and tone color setting data DBi having the same filename as the loaded song data DAi (step P4).

If the style and tone color setting data DBi associated with the song data DAi has been created by the user, that is, if the style and tone color setting data DBi having the same filename as the selected song data DAi is contained among the style and tone color setting data DB1 through DBn stored in the style and tone color setting data file DB [FIG. 2 (*b*)] in the external storage device 4 (step P4=YES), the CPU 1 loads the style and tone color setting data DBi into the memory 2 (step P5). A style and tone color for manual performance based on the style setting data SS and tone color setting data VS of the loaded style and tone color setting data DBi are then set on the electronic musical instrument (step P6).

On the other hand, if the style and tone color setting data DBi associated with the song data DAi has not been created (at the initial use of the electronic musical instrument, in particular, no style and tone color setting data DB1 through DBn has been created), that is, if the style and tone color setting data DBi having the same filename as the loaded song data DAi is not contained (P4=NO), the CPU 1 searches sets (m sets) of the style data DC1 through DCm stored in the style data file DC [FIG. 2 (*c*)] in the ROM 3 or external storage device 4 for a style which suits the song data DAi (step P7). That is, at the search step (P7) the tempo data TPa and meter data TMa of the song data DAi are compared with the tempo data TPc and meter data TMc of the style data DC1 through DCm in order to locate the style data DCj (j: 1 through m) having a tempo and meter matching the tempo and meter of the song. Then at the search step (P7) the accompaniment pattern data AC of the located style data DCj is loaded into the memory 2 in order to set the style which suits the song.

At the search process (P7), a style "matching" a tempo of a song refers to a case where the tempo (TPc) of the style (DCj) is the same as the tempo (TPa) of the song (DAi) or close to the tempo (TPa) of the song (DAi) (i.e., falling within a predetermined range), while a style "matching" a meter of a song refers to a case where the meter (TMc) of the style (DCj) is the same as the meter (TMa) of the song (DAi). If the search results in sets of matching style data (DCj) located, methods for automatically selecting one of the matching style data sets may be adopted. The methods include, for example, selecting one set from among the candidates of the style data on a random basis and selecting a set of the style data having the smallest style number (j). Alternatively, the selection may be left to the user.

After the style search process (P7), the CPU 1 loads the default tone color setting data DV provided for the style data DCj determined at the style search into the memory 2 and sets on the electronic musical instrument a tone color for manual performance provided for the style as a default setting (step P8).

After the style and tone color for manual performance are set as described above (P6 through P8), the CPU 1 sets a tempo indicated by the tempo data TMa of the selected song data DAi (step P9), the tempo being used for the progression of the processes of the melody data ML, chord progression data CS and lyric data LY of the song data DAi. The CPU 1 then terminates the song selection process and returns to the main process.

Figure 4:
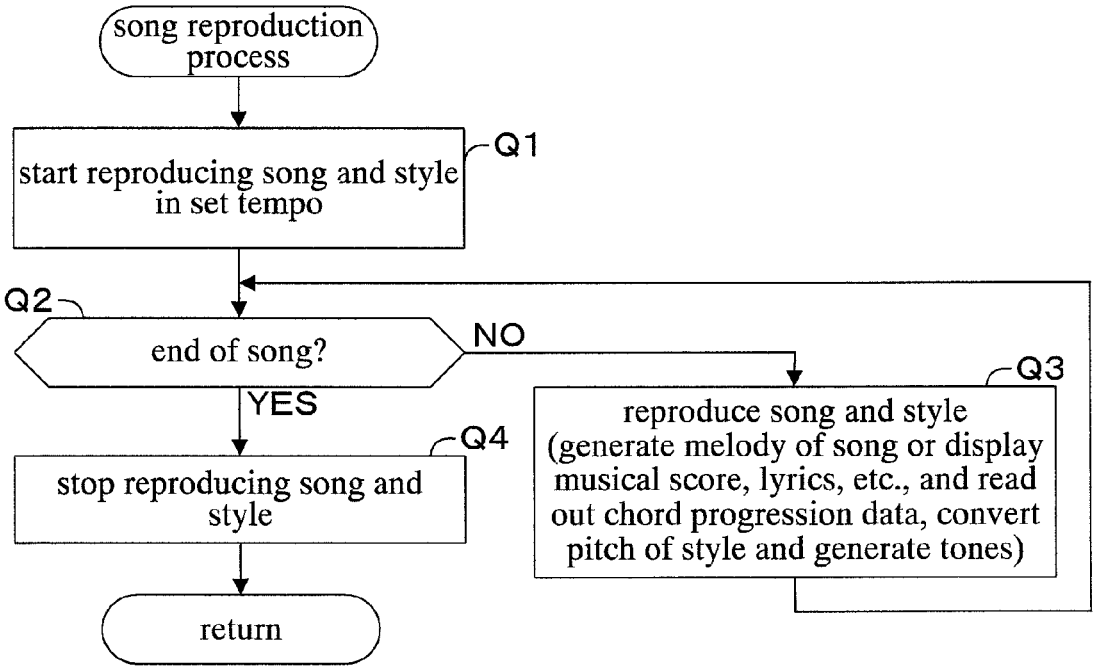
FIG. 4 is a flowchart showing an example of operations done in a song reproduction process according to the embodiment of the present invention.

[2] Song Reproduction Process (FIG. 4)

When an operator of the setting operators 15 for instructing the start of the reproduction of a song (automatic performance) is operated by the user, the CPU 1 starts a process for reproducing, in the tempo (P9) set at the song selection process (FIG. 3), the song (P3) based on the selected song data DAi and, the style (P6, P7, P8) based on the style and tone color setting data DBi or the style data DCj provided in association with the song (step Q1). The CPU 1 then continues the operations of the process of reproducing the song and style (step Q3) until the process reaches the end of the song data DAi (P3) (step Q2=NO).

On reproducing the song at the above step reproducing the song and style (Q3), melody tones are generated from a musical tone generating portion 8, 9, and 17, or visual musical information such as musical score or lyrics are displayed on the display unit 16 on the basis of the melody data ML, chord progression data CS or lyric data of the song data DAi. On reproducing the style at the step reproducing the song and style, the CPU 1 reads the chord progression data CS and converts a pitch of the style in order to generate accompaniment tones in accordance with the style data DCk (P6) indicated by the style setting data SS of the style and tone color setting data DBi or the accompaniment pattern data AC of the style data DCj (P8).

Figure 6:
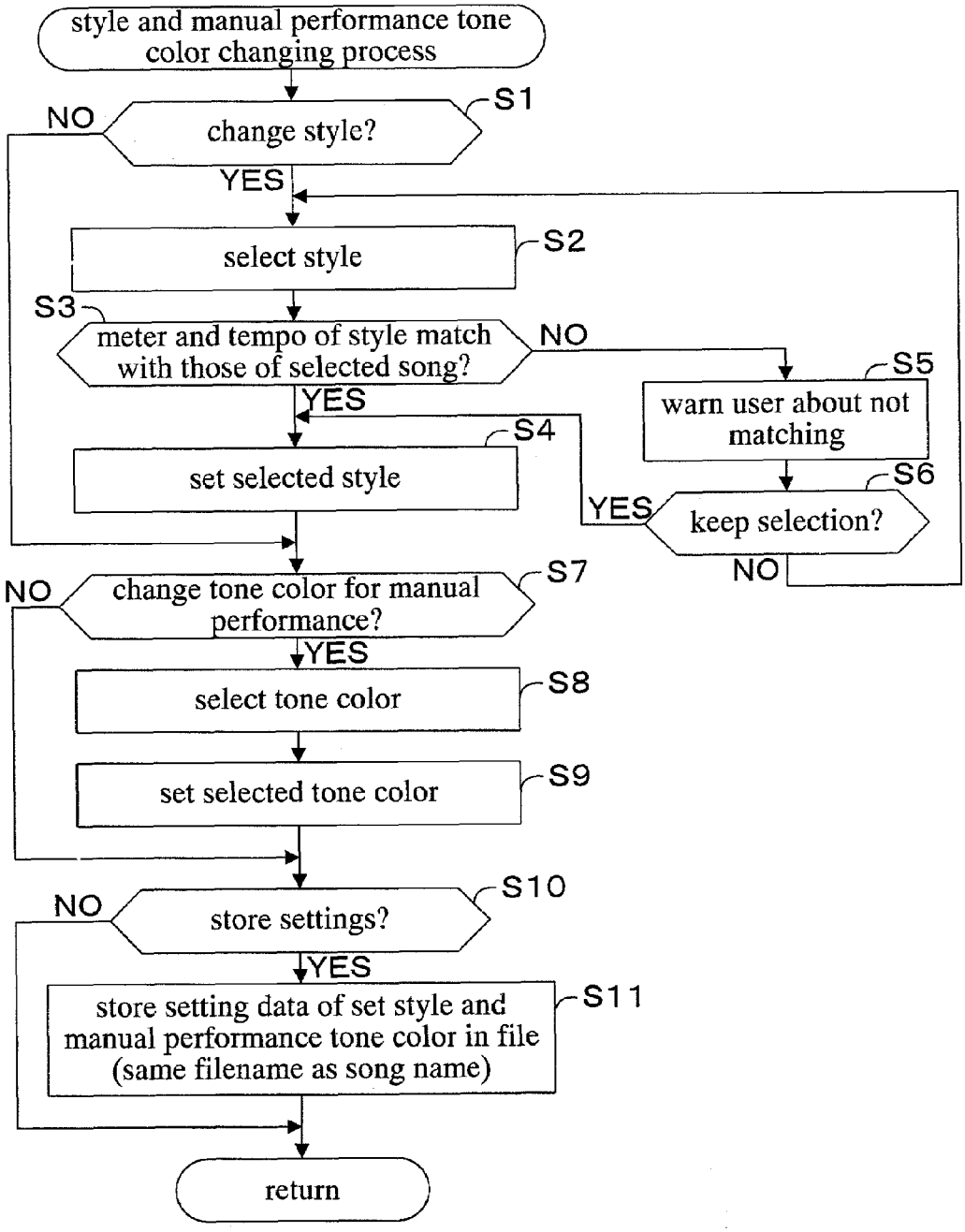
FIG. 6 is a flowchart showing an example of operations done in a style and manual performance tone color changing process according to the embodiment of the present invention.

At the process reproducing the song and style (Q3), if the meter of the song does not match the meter of the style such as a case where the user has purposely selected, at the style changing process (FIG. 6: S1 through S6) which will be described later, the style data DCj having a meter (TMc) which does not match the meter (TMa) of the song data DAi, the CPU 1 exercises control in order to match the meter of the style with that of the song by adopting a method such as omitting or repeating some beats.

When the process reproducing the song and style reaches the end (end data) of the song data DAi (step Q2=YES), the CPU 1 stops reproducing the song and style and terminates the song reproduction process in order to return to the main process.

Figure 5:
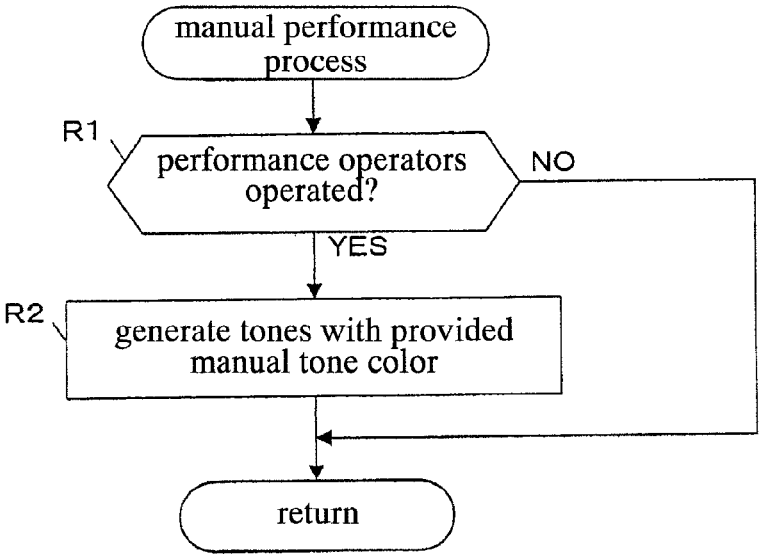
FIG. 5 is a flowchart showing an example of operations done in a manual performance process according to the embodiment of the present invention.

[3] Manual Performance Process (FIG. 5)

The CPU 1 continuously executes the manual performance process in order to monitor whether the performance operators 14 such as a keyboard have been operated by the user or not (step R1). However, when the performance operators 14 are not operated (R1=NO), the CPU 1 immediately passes through the manual performance process and returns to the main process.

On the other hand, when the CPU 1 has detected operations of the performance operators 14 (R1=YES), the CPU 1 causes the musical tone generating portion 8, 9, and 17 to generate musical tones corresponding to the operations with the provided tone color for manual performance (step R2). At the musical tone generating portion 8, 9, and 17, more specifically, performance data generated in accordance with operations by the performance operators 14 is converted to musical tone signals having a desired tone color in accordance with the tone color setting data VS (P6) of the style and tone color setting data DBi or the default tone color setting data DV (P8) of the style data DCj provided in association with the song data DAi selected at the song selection process (FIG. 3), being output as musical tones. After outputting the musical tones, the CPU 1 terminates the manual performance process and returns to the main process in order to wait for the next operations by the performance operators 14.

[4] Style and Manual Performance Tone Color Changing Process (FIG. 6)

When a predetermined operator of the setting operators 15 is operated in order to give an instruction to start the style and manual performance tone color changing process, the CPU 1 first displays a style and performance tone color changing screen on the display unit 16 and prompts the user to input a change in the style and tone color for manual performance. When operated by the user are the setting operators 15 for changing the style (step S1=YES), the CPU 1 displays on the display unit 16 a style selection screen showing a style list comprising style names and required items in order to present to the user sets (m sets) of style data DC1 through DCn [FIG. 2 (*c*)] stored in the style data file DC in the ROM 3 or external storage device 4.

When a desired style is selected from the style list by the user's operation (step S2), the CPU 1 compares the tempo data TPc and meter data TMc of the style data DCk (k: 1 through m) corresponding to the selected style with the tempo data TPa and meter data TMa of the previously selected song data DAi in order to determine whether the tempo and meter of the selected style match with those of the selected song (step S3). As in the cases of the search process step (P7) of the song selection process (FIG. 3), "to match" refers to a case where the tempo (TPc) of the style (DCk) is the same as or close to the tempo (TPa) of the song (DAi), and the meter (TMc) of the style (DCk) is the same as the meter (TMa) of the song (DAi).

When the meter and tempo of the style match with the meter and tempo of the song (S3=YES), the CPU 1 adopts the selected style (step S4). At the style setting step (S4), more specifically, the style data DCk associated with the selected style is adopted as the style data which suits the song data DAi, and the data indicative of the style data DCk is set as the style setting data SS which is associated with the song data DAi.

On the other hand, when the meter and tempo of the style do not match with those of the song (S3=NO), a warning that the selected style (DCk) does not match with the song (DAi) is given to the user through the screen or the like (step S5). The CPU 1 then asks the user on the screen whether he/she keeps his/her selection or not (step S6). When the user inputs a response indicating that he/she keeps the selection (S6=YES), the CPU 1 proceeds to the above-described style setting step (S4) and purposely adopts the style data DCk which does not match with the song data DAi as the style associated with the song.

On the other hand, when the user inputs a response indicating that he/she does not keep the selection (S6=NO), the CPU 1 returns to the style selecting step S2 in order to prompt the user to select a different style. The CPU 1 then repeats the above-described steps (S2→S3(NO)→S5→S6) until the newly selected style is associated with the song. When the newly selected style matches with the song (S3=YES) or the user inputs a response indicating that he/she keeps the new selection (S6=YES), the CPU 1 proceeds to the style setting step (S4) and adopts the newly selected style as a style associated with the song.

Next, when the CPU 1 determines that the user's operation is not for instructing a change in the style (S1=NO), or the style setting process (S4) has been done, the CPU 1 further determines whether operated by the user are the setting operators 15 for changing a tone color for manual performance or not (step S7). Since in the tone color data file in the ROM 3 or the external storage device 4 there are stored sets of tone color data in order to allow performance data generated on the basis of operations by the performance operators 14 to have a desired tone color, when the instruction for changing a tone color for manual performance has been given (S7=YES), the CPU 1 displays on the display unit 16 a screen for selecting a tone color in order to show a tone color list representing names and details of tone colors of the tone color data.

When a user's desired tone color has been selected from the tone color list through user's operation (step S8), the CPU 1 adopts the selected tone color to the song (step S9). More specifically, data indicative of tone color data corresponding to the desired tone color in the tone color data file is set as the tone color setting data VS associated with the song data DAi.

When the user's operation is not for changing a tone color for manual performance (S7=NO), or the tone color setting process has been done (S9), the CPU 1 further determines whether an instruction to store the settings has been given through user's operation or not (step S10). When the instruction to store the settings has been given (S10=YES), the CPU 1 conducts a setting data storing process (step S11). More specifically, the CPU 1 stores, in the style and tone color setting data file DB in the external storage device 4, the style and/or manual performance tone color setting data SS and/or VS set at the style and/or tone color setting step (S4 and/or S9) as the style and tone color setting data DBi (having the same filename as the song data DAi with a different extension) associated with the song data DAi (step S11).

When the user's operation is not an instruction to store the setting data (S10=NO), or an instruction to terminate the changing process has been given after the setting data storing process (S11), the CPU 1 terminates the changing process and returns to the main process.

Various Embodiments

The preferred embodiment of the present invention has been described above, with reference to the accompanying drawings made. However, the above embodiment is merely an example, and it will be understood that various modifications may be made in the present invention and the present invention may be variously embodied without departing from the spirit and scope of the invention.

In the above embodiment, for example, the style and tone color setting data (DB) has been described as a separate file having the same filename as the associated song data, however, other methods may be applicable. For example, a setting file may store a plurality of correspondences defined between song data and style and tone color setting data.

As for settings of style and tone color, the above-described embodiment is adapted to set and store both the style and tone color, however, the embodiment may be adapted to set and store either one of them. Furthermore, the embodiment may be modified to set and store other pieces of information such as a loudness, effect and performance mode (e.g., normal, dual, split, etc.) for manual performance, and modes on reproducing style data (e.g., switches of mute on one part among accompaniment parts, change in tone color for one part among accompaniment parts, loudness of the accompaniment and accompaniment section [introduction, main, fill-in, ending, etc.]).

An apparatus to which the present invention is applied is not limited to an electronic musical instrument, but may be a personal computer with application software. Furthermore, applicable apparatuses include a karaoke apparatus, game apparatus, portable terminal such as a mobile phone and automatically performed piano. As for the applicable portable terminal, all the needed functions may be contained in the portable terminal, but some of the functions may be left to a server so that all the functions can be achieved as a system comprising the terminal and server.

What is claimed is:

1. An electronic musical apparatus having an automatic performance feature, the apparatus comprising:

a song storage portion for storing sets of song data for automatic performance of music;

a performance tone color setting portion for setting, on the basis of user's operation, tone color setting data indicating a tone color for performance data generated in accordance with user's manual performance operation operated concurrently with automatic reproduction of song data from said song storage portion;

a performance tone color storage portion for storing the set tone color setting data in association with said song data, the tone color setting data being stored separately from the song data;

a reproduction portion for concurrently reproducing said song data selected from said song storage portion and performance data performed by said user, while imparting, to said performance data manually performed by said user, said tone color based on said tone color setting data read out from said performance tone color storage portion in association with said song data; and a style data storing portion for storing sets of style data, including tone color data for user's manual performance, the style data being stored separately from the song data, wherein the reproduction portion comprises:

a search portion for searching the style data that match the song data if the tone color setting data in association with the song data is not stored in said performance tone color storage portion; and an impart portion for imparting, to the performance data manually performed by the user, the tone color based on the tone color data included in the searched style data.

2. An electronic musical apparatus according to claim 1, wherein said song data includes melody data and chord progression data.

3. A computer-readable medium storing a computer program applied to a musical tone information processing apparatus comprising a song storage portion for storing sets of song data for automatic performance of music and a performance tone color storage portion, said computer program including instructions for:

setting, on the basis of user's operation, tone color setting data indicating a tone color for performance data generated in accordance with user's manual performance operation operated concurrently with reproduction of song data from said song storage portion to store the set style setting data in association with said song data;

storing the set tone color setting data in association with said song data in the performance tone color storage portion, the tone color setting data being stored separately from the song data;

concurrently reproducing said song data selected from said song storage portion and the performance data generated in accordance with the user's manual performance operation, while imparting, to said performance data, said tone color based on said tone color setting data read out from said performance tone color storage portion in association with said song data; and storing sets of style data, including tone color data for user's manual performance, the style data being stored separately from the song data, wherein the reproducing instruction comprises:

searching the style data that match the song data if the tone color setting data in association with the song data is not stored in said performance tone color storage portion; and imparting, to the performance data manually performed by the user, the tone color based on the tone color data included in the searched style data.

4. A computer-readable medium according to claim 3, wherein said song data includes melody data and chord progression data.

* * * * *